US006238807B1

(12) United States Patent
Yasuda et al.

(10) Patent No.: US 6,238,807 B1
(45) **Date of Patent: *May 29, 2001**

(54) THERMAL SPRAYING COMPOSITE MATERIAL CONTAINING MOLYBDENUM BORIDE AND A COAT FORMED BY THERMAL SPRAYING

(75) Inventors: Tsujihiko Yasuda; Akiyoshi Banno, both of Nagoya; Tamio Ito, Iwakura; Koji Kiyoshi; Kunimoto Ishibayashi, both of Shiojiri, all of (JP)

(73) Assignees: Chubu Sukegawa Enterprise Co., Ltd., Nagoya; Showa Denko Kabushiki Kaisha, Tokyo, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/900,710

(22) Filed: Jul. 25, 1997

(51) Int. Cl.[7] ..... B32B 15/04; B32B 15/01; C25D 5/10; C04B 35/00

(52) U.S. Cl. ..... 428/627; 428/663; 428/668; 428/680; 428/937; 501/96.3

(58) Field of Search ..... 428/621, 627, 428/663, 680, 668, 699, 937; 427/456, 419.7, 427; 501/96.3, 95.2

(56) References Cited

U.S. PATENT DOCUMENTS

| | | | | |
|---|---|---|---|---|
| 3,837,894 | * | 9/1974 | Tucker, Jr. | 117/70 A |
| 4,292,081 | * | 9/1981 | Watanabe et al. | 501/96 |
| 4,671,822 | * | 6/1987 | Hamashima et al. | 75/244 |
| 4,873,053 | * | 10/1989 | Matsushita et al. | 419/11 |
| 5,395,661 | * | 3/1995 | Mizunuma et al. | 427/451 |
| 5,711,613 | * | 1/1998 | Ookouchi et al. | 384/283 |

FOREIGN PATENT DOCUMENTS

| | | | |
|---|---|---|---|
| 3-94048 | * | 4/1991 | (JP) . |
| 6-144971 | * | 5/1994 | (JP) . |
| 6-144972 | * | 5/1994 | (JP) . |
| 6-144973 | * | 5/1994 | (JP) . |
| 7-3376 | * | 5/1994 | (JP) . |
| 6-144973 | * | 1/1995 | (JP) . |
| 7-3376 | * | 1/1995 | (JP) . |
| 7-62516 | | 3/1995 | (JP) . |

* cited by examiner

*Primary Examiner*—Paul Thibodeau
*Assistant Examiner*—Holly C. Rickman
(74) *Attorney, Agent, or Firm*—Arent Fox Kintner Plotkin & Kahn, PLLC

(57) ABSTRACT

A protective coat formed by thermal spraying, and having an outstanding durability against corrosion by a molten light alloy. A thermal spraying composite material used to form such a coat contains from about 30 to about 70% by weight of molybdenum boride, from about 20 to about 40% by weight of nickel or cobalt, from about 5 to about 20% by weight of chromium, and from about 5 to about 10% by weight of at least one metal boride selected from the borides of Cr, W, Zr, Ni and Nb.

13 Claims, 2 Drawing Sheets

THERMAL SPRAYING COMPOSITE MATERIAL CONTAINING MOLYBDENUM BORIDE AND A COAT FORMED BY THERMAL SPRAYING

BACKGROUND OF THE INVENTION

1. Field of the Invention

This invention relates to a thermal spraying composite material containing molybdenum boride, and more particularly, to a thermal spraying composite material for forming a coat to protect mechanical equipment from corrosion by any molten light metal or alloy, such as aluminum, zinc or alloys of these.

2. Description of Related Art

Die casting, gravity casting, or differential pressure casting have been usual processes for casting a product from a metal having a relatively low melting point, such as aluminum, zinc or magnesium.

Differential pressure casting is, among these, considered suitable for making large castings having fewer internal defects. FIG. 2 shows an apparatus employed for differential pressure casting. A suction port 6 is used to create a lower pressure in a mold 5 than in a holding furnace 1, so that a molten metal 10 may rise from the holding furnace 1 through a stoke 2 and form a laminar flow through a sleeve 4 to fill the mold 5 for one cycle of the casting operation. When the molten metal has solidified on the inner surface of the mold 5, the next cycle of the casting operation is started, and the remaining molten metal flows down into the holding furnace 1 through the sleeve 4.

The sleeve 4 has its inner surface washed by the molten metal 10 having a high temperature during each cycle of the casting operation, and thereby corroded, and is eventually fractured. The higher temperature the molten metal has, the shorter life the sleeve 4 has.

The molten light alloys have usually been used for casting at relatively low temperatures in the range of 700–750° C. and the protective coats of the sleeve 4 and the mold, have been made of, for example, a mixture of tungsten carbide and cobalt having a cobalt content of 12% by weight, as described in the Japanese Unexamined Patent Application No. Hei 7-62516.

Many foundries have, however, come to employ higher molten metal temperatures in the range of 750–850° C. for making products of higher accuracy by the differential pressure casting.

When exposed to any such higher molten metal temperature, the protective coats of tungsten carbide and cobalt have been found lacking in durability, and particularly in oxidation resistance, and heavily worn by oxidation not only on the sleeve 4, but on the inner surface of the mold 1 as well, owing to low oxidation resistance of tungsten carbide at high temperature. A greatly shortened mold life has led to increase in the cost of the casting operation.

SUMMARY OF THE INVENTION

Under these circumstances, it is an object of this invention to provide a thermal spraying composite material which can form a protective coat having an improved durability when exposed to a molten light alloy having higher temperatures.

This object is attained by a thermal spraying composite material comprising:

molybdenum boride (MoB), from about 30 to about 70% by weight;

nickel (Ni) or cobalt (Co), from about 20 to about 40% by weight;

chromium (Cr), from about 5 to about 20% by weight; and at least one metal boride selected from the borides of Cr, W, Zr, Ni and Nb, from about 5 to about 10% by weight.

It is another object of this invention to provide a thermally sprayed coat having improved durability when exposed to a molten light alloy having higher temperatures.

This object can be achieved by a coat comprising:

a first layer formed on a substrate to be protected from a heat-resisting alloy having a coefficient of thermal expansion close to that of the base;

a second layer formed on the first layer from a material comprising from about 30 to about 70% by weight of molybdenum boride (MoB), from about 20 to about 40% by weight of nickel (Ni) or cobalt (Co), from about 5 to about 20% by weight of chromium (Cr), and from about 5 to about 10% by weight of at least one metal boride selected from the borides of Cr, W, Zr, Ni and Nb; and a third layer formed on the second layer from a ceramic material with low wettability to any molten light metal.

The first layer serves as a buffer between the substrate to be protected and the second layer of a composite material containing molybdenum boride, and is preferably of an alloy having a coefficient of thermal expansion between those of the substrate and the second layer. It may alternatively be formed by thermally spraying a metal having a coefficient of thermal expansion close to that of the second layer, and a good compatibility with the base.

The second layer plays the most important role in protecting the substrate from corrosion by any molten light alloy having a higher temperature. The role will be described in further detail.

The third layer is a very hard layer serving to protect the second layer from any physical damage otherwise given to the second layer by a violently flowing molten metal, or any other external force, as produced by striking.

DESCRIPTION OF THE PREFERRED EMBODIMENTS

Figure 1:
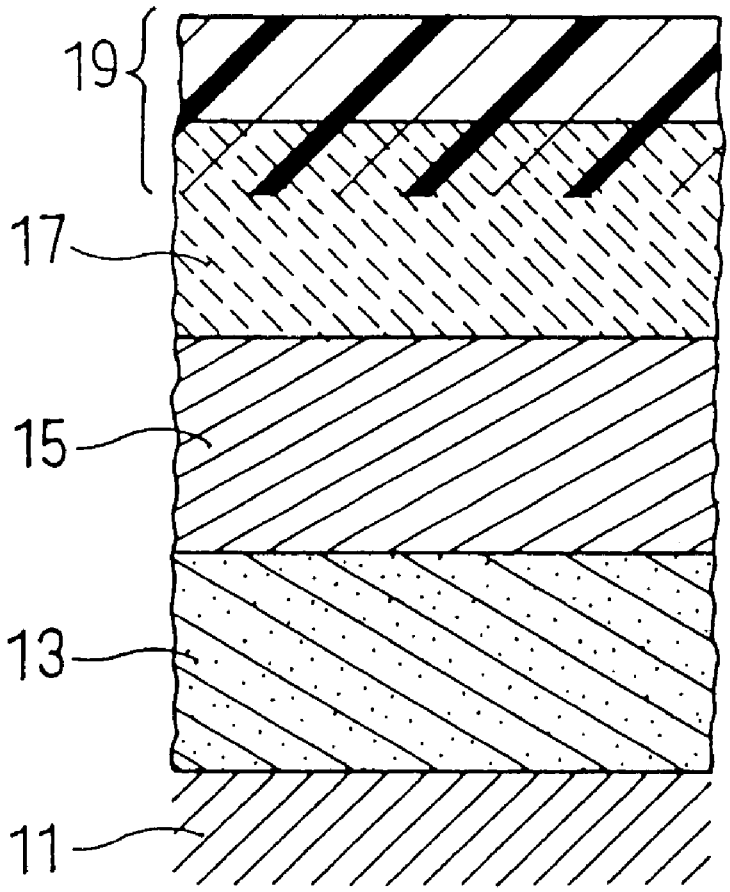
FIG. 1 is a schematic sectional view of a coat embodying this invention.
Figure 2:
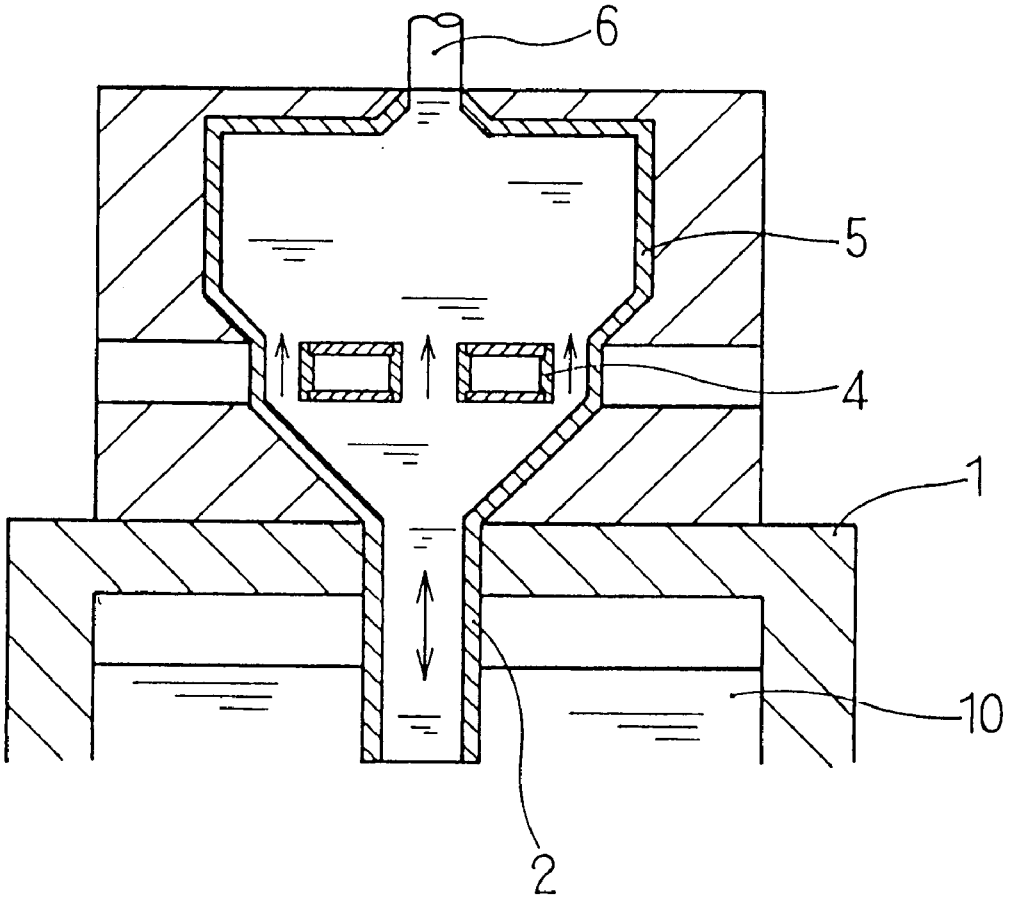
FIG. 2 is a schematic sectional view of an apparatus for differential pressure casting.

The invention will now be described in further detail by way of its preferred embodiments. Every number used in the following description to indicate the percentage is based on weight, unless otherwise noted.

A. Thermal spraying composite material:

(1) The thermal spraying composite material of this invention comprises:

molybdenum boride (MoB), from about 30 to about 70% (and preferably, from about 40 to about 60%) by weight;

nickel (Ni) or cobalt (Co), from about 20 to about 40% (and preferably, from about 20 to about 30%) by weight;

chromium (Cr), from about 5 to about 20% (and preferably, from about 10 to about 15%) by weight; and at least one metal boride selected from the borides of Cr, W, Zr, Ni and Nb, from about 5 to about 10% (and preferably, from about 5 to about 8%) by weight.

The following is a description of each component and its properties and function:

(a) MoB exists as a hard phase in a thermally sprayed layer, is superior to WC in stability at a high temperature, and provides an improved resistance to corrosion by a molten light alloy. If its proportion is less than 30%, it fails to provide any satisfactory corrosion resistance, while its excess over 70% results in a brittle film.

(b) Ni or Co is used to form a binding phase because of its ductility. Its proportion below 20% results in a brittle film, while its excess over 40% results in too soft a film.

(c) Cr gives Co oxidation resistance. Its proportion below 5% results in its failure to provide any satisfactory oxidation resistance, while its excess over 20% is not expected to produce any better result.

(d) The metal boride selected from the borides of Cr, W, Zr, Ni and Nb is of a transition metal belonging to the same group (Group 6), or period (Period 5) with Mo in the periodic table of elements, and serves to provide a stronger bond between molybdenum boride as a base phase and NiCr or CoCr as a binding phase. $CrB_2$ is, among these metal borides, preferred because of its strong bonding property. Its proportion below 5% results in its failure to provide any satisfactorily strong bonding action, while its excess over 10% is not expected to produce any better result.

(2) The thermal spraying composite material as described above is prepared from fine powders of its components each having a particle diameter of usually 10 μm or below. The powders are uniformly mixed, the powder mixture is agglomerated, the agglomerated mixture is sintered, the sintered product is crushed, and the resulting particles are classified. Common machines and apparatus are used for mixing, agglomerating and classifying purposes. The sintering is carried out at temperatures of from 900° C. to 1350° C., and preferably from 1000° C. to 1250° C., for 2 to 4 hours. The particles are so classified as to have a diameter of 5 to 125 μm, and preferably so that 70% or more of the particles may have a diameter of 10 to 106 μm.

B. Coat formed by thermal spraying:

(1) Although the thermal spraying composite material as described above may be used to form a protective coat consisting solely of it, it is more effective to use the material in a multi-layer coat, when circumstances are described below.

① The substrate to be protected is, for example, of a metal having a coefficient of thermal expansion differing greatly from that of the thermal spraying composite material; ② It is necessary to ensure the formation of a protective coat which has low wettability to any molten light alloy, and ③ The protective coat is worn by violent flow of any molten light alloy.

FIG. 1 shows the construction of a preferred form of a protective multi-layer coat according to this invention. The multi-layer coat comprises three layers formed by thermal spraying on a substrate 11 to be protected: a first layer 13 formed on the substrate 11 from a heat-resisting alloy having a coefficient of thermal expansion close to that of the substrate 11, a second layer 15 formed on the first layer 13 from the thermal spraying composite material of this invention, and a third layer 17 formed on the second layer 15 from a hard ceramic material with low wettability to any molten light alloy.

The third layer 17 is preferably impregnated with a reinforcing layer 19 of a heat-resisting organosilicon compound, since the third layer 17 usually has fine pores and easily cracks upon receiving a thermal shock.

(2) The substrate to be protected may be of any material not particularly limited, but including as preferred examples ferrous or non ferrous material, such as cast iron having a thermal expansion coefficient of $10\times10^{-6}/°$ C., or steel having a thermal expansion coefficient of $12\times10^{-6}/°$ C. or aluminum alloy having a thermal expansion coefficient of $20\times10^{-6}/°$ C. The substrate preferably has its surface roughened by shot blasting, prior to the formation of the first layer of the protective coat thereon, so that the first layer may adhere to the substrate still more firmly.

(3) The heat-resisting alloy forming the first layer of the protective coat may be selected from among, for example, nickel-chromium-aluminum (NiCrAl) alloys containing from about 18 to about 48% Cr and from about 4 to about 10% Al the balance being nickel, a NiCrAlY alloy containing from about 16 to about 25% Cr, from about 6 to about 13% Al and from about 0.5 to about 1.0% Y, the balance being nickel, a CoCrAlY alloy containing from about 20 to about 25% Cr, from about 11 to about 15% Al and from about 0.5 to about 1.0% Y, the balance being cobalt, and a stellite alloy containing from about 20 to about 30% Cr, from about 0.1 to about 2.5% C, from about 4 to about 18% W, from about 1 to about 6% Mo, from about 3 to about 10% Ni, from about 1 to about 2% Si and from about 1 to about 3% Fe, the balance being cobalt. These alloys have a coefficient of thermal expansion in the range of approximately (15 to 16)$\times10^{-6}/°$ C. NiCrAlY and CoCrAlY are, among these, preferred, since $Cr_2O_3$ and $Al_2O_3$ are formed on the surface of the first layer exhibiting an excellent resistance to oxidation at high temperature, while $Y_2O_3$ produces a wedge effect to make the first layer adhere firmly to the second layer of the thermal spraying composite material.

The first layer has a thickness of 20 to 200 μm, and a preferred thickness of 40 to 100 μm. If it has a smaller thickness, it does not provide any satisfactory protection for the substrate to be protected, or act as a satisfactory buffer between the substrate and the second layer. Even if it may have a larger thickness, it cannot be expected to produce any correspondingly better result, but is undesirable from an economical standpoint.

The first layer may be formed by any thermal spraying method carried out in an environment having an air atmosphere under atmospheric pressure, or an adjusted atmosphere under reduced pressure, and including flame spraying or detonation-flame spraying, or plasma spraying. Plasma spraying is, however, preferred, since it hardly causes any deterioration in the quality of the thermal spraying material, and can form a layer adhering firmly to the substrate.

(4) The second layer of the protective coat is formed from the thermal spraying composite material as described at (A) above. The second layer which hardly reacts with the molten metal is mainly intended for imparting heat resistance and corrosion to the substrate to be protected resistance to the molten metal.

The second layer has a thickness of 20 to 200 μm and a preferred thickness of 50 to 150 μm. If it has a smaller thickness, it does not provide any satisfactory protection for the base. Even if it may have a larger thickness, it cannot be expected to produce any correspondingly better result, but is undesirable from an economical standpoint.

The second layer may be formed by any method employed for forming the first layer as stated above.

(5) The ceramic material with low wettability to any molten light alloy forming the third layer of the protective coat is preferably selected from among partially stabilized zirconias, such as $ZrO_2.Y_2O_3$ and $ZrO_2.CaO$, and an alumina-zirconia mixture containing from about 60 to about 70% $Al_2O_3$ and from about 30 to about 40% $ZrO_2$. It is particularly preferable to use partially stabilized zirconia obtained by adding several percent of rare earth oxides (e.g. $Y_2O_3$), CaO or MgO to zirconia to inhibit any phase transformation.

The third layer has a thickness of 20 to 200 μm and a preferred thickness of 50 to 150 μm. If it has a smaller thickness, it does not ensure low wettability any molten metal. Even if it may have a thickness over 200 μm, it cannot be expected to produce any correspondingly better result, but is undesirable from an economical standpoint.

The third layer may also be formed by any method employed for forming the first layer as stated above.

(6) Polymetallocarbosilane and diphenylsilicone are examples of the heat-resisting organosilicon compounds which can be used to impregnate and reinforce the third layer. Polymetallocarbosilane is preferred because of its high heat resistance and its outstanding property of impregnating the surface of the third layer.

The reinforcing layer is formed by impregnating the third layer with a solution of an organosilicon compound by spraying or dipping, and preferably baking it at temperatures of 200° C. to 500° C. for 10 to 60 minutes.

EXAMPLES

Description will now be made of Examples and Comparative Examples in which tests were conducted to make sure the effects and advantages of this invention.

(1) Preparation of Testpieces

Example 1

A three-layer coat was formed by plasma spraying with a plasma gas of Ar and $H_2$ on a protective tube made of 27Cr steel, having a thermal expansion coefficient of $6.0\times10^{-6}$/° C. and measuring 21.3 mm in diameter, 2.65 mm in wall thickness and 250 mm in length. The three layers were:

A first layer formed from CoCrAlY containing 23% Cr, 13% Al and 0.6% Y, the balance being cobalt, and having a thickness of 100 μm;

A second layer formed from a thermal spraying composite material containing 30% Co, 15% Cr and 5% $CrB_2$, the balance being molybdenum boride, and having a thickness of 100 μm; and A third layer formed from an alumina-zirconia mixture consisting of 70% $Al_2O_3$ and 30% $ZrO_2$, and having a thickness of 100 μm.

The third layer was reinforced with an impregnating layer of an organosilicon resin dried at 300° C. for 120 minutes.

Example 2

A three-layer coat was formed by plasma spraying with a plasma gas of Ar and $H_2$ on a protective tube made of 27Cr steel, having a thermal expansion coefficient of $6.0\times10^{-6}$/° C. and measuring 21.3 mm in diameter, 2.65 mm in wall thickness and 250 mm in length. The three layers were:

A first layer formed from CoCrAlY containing 23% Cr, 13% Al and 0.6% Y, the balance being cobalt, and having a thickness of 100 μm;

A second layer formed from a thermal spraying composite material containing 30% Ni, 8% Cr and 10% $CrB_2$, the balance being molybdenum boride, and having a thickness of 100 μm; and A third layer formed from an alumina-zirconia mixture consisting of 70% $Al_2O_3$ and 30% $ZrO_2$, and having a thickness of 100 μm.

The third layer was reinforced with an impregnating layer of an organosilicon resin dried at 300° C. for 120 minutes.

Comparative Example 1

A B/N glass mixture was applied onto the same substrate as employed in EXAMPLE 1, and baked to form a coat having a thickness of 300 μm.

Comparative Example 2

A film of stabilized zirconia having a thickness of 350 μm was formed by plasma spraying on the same base as employed in EXAMPLE 1.

(2) Heat-cycle tests conducted by dipping in a molten aluminum alloy

Each two of the three testpieces which had been prepared in each EXAMPLE 1.2 or COMPARATIVE EXAMPLE 1.2 respectively were given a heat-cycle test conducted by employing a dipping apparatus containing a molten bath of an Al—Si alloy, AC-2C, having the composition shown in Table 1, and dipping each testpiece therein. Each test was conducted by repeating a heat cycle consisting of seven minutes for which the testpiece was left to stand in the molten bath, and one minute for which it was thereafter allowed to cool in the air outside the bath.

After every 500 cycles had been repeated, each testpiece was examined for any change in its outside diameter, and for any damage on its film. Its outside diameter was measured at three points spaced apart from one end thereof by 20 mm, 40 mm and 60 mm, respectively. The aluminum alloy adhering to each testpiece was removed by applying the heat of a burner to melt it each time the outside diameter of the testpiece was measured. On that occasion, the utmost care was taken to apply only a thermal shock to the testpiece without striking it, or giving any other mechanical shock to it.

(3) Test results

The test results are shown in Tables 2 and 3. As is obvious therefrom, the coats formed from the thermal spraying composite materials of this invention exhibited about twice as high a level of durability as that of any coat formed from the conventional methods.

TABLE 1

| Alloy | Al | Si | Cu | Fe | Mn | Mg | Zn | Ti |
|---|---|---|---|---|---|---|---|---|
| AC-2C | Bal | 5–7 | 2–4 | <0.5 | 0.2–0.4 | 0.2–0.4 | <0.5 | <0.2 |

TABLE 2

| | | Testpiece | | | | | | | |
|---|---|---|---|---|---|---|---|---|---|
| | | Example 1 | | Example 2 | | Comparative Example 1 | | Comparative Example 2 | |
| Heat cycle | | No. 1 | No. 2 | No. 1 | No. 2 | No. 1 | No. 2 | No. 1 | No. 2 |
| Initial (Standard) | 20 mm | 21.9 | 21.9 | 22.0 | 21.9 | 23.0 | 22.7 | 22.2 | 22.1 |
| | 40 mm | 21.9 | 21.9 | 22.0 | 21.9 | 22.8 | 22.6 | 22.1 | 22.1 |
| | 60 mm | 22.0 | 21.9 | 21.9 | 21.9 | 22.5 | 22.5 | 22.1 | 22.1 |
| | X | 21.92 | | 21.93 | | 22.68 | | 22.12 | |

TABLE 2-continued

| Heat cycle | | Testpiece: Example 1 No. 1 | Example 1 No. 2 | Example 2 No. 1 | Example 2 No. 2 | Comparative Example 1 No. 1 | Comparative Example 1 No. 2 | Comparative Example 2 No. 1 | Comparative Example 2 No. 2 |
|---|---|---|---|---|---|---|---|---|---|
| 500 | 20 mm | 21.8 | 21.9 | 21.8 | 21.8 | 22.8 | 22.6 | 22.1 | 22.1 |
| | 40 mm | 21.8 | 21.9 | 21.8 | 21.9 | 22.5 | 22.5 | 22.0 | 22.0 |
| | 60 mm | 21.9 | 21.9 | 21.9 | 21.9 | 22.4 | 22.4 | 22.1 | 22.1 |
| | X | 21.87 | | 21.85 | | 22.53 | | 22.07 | |
| 1000 | 20 mm | 21.8 | 21.8 | 21.8 | 21.8 | 22.6 | 22.7 | 22.1 | 22.1 |
| | 40 mm | 21.8 | 21.8 | 21.9 | 21.9 | 22.5 | 22.6 | 22.0 | 22.0 |
| | 60 mm | 21.8 | 21.8 | 21.9 | 21.9 | 22.4 | 22.4 | 22.1 | 22.0 |
| | X | 21.80 | | 21.87 | | 22.53 | | 22.05 | |
| 1500 | 20 mm | 21.8 | 21.8 | 21.7 | 21.8 | 22.2 | 22.0 | 22.1 | 21.8 |
| | 40 mm | 21.9 | 21.8 | 21.8 | 21.9 | 22.2 | 21.9 | 21.6 | 21.6 |
| | 60 mm | 21.8 | 21.8 | 21.9 | 21.9 | 22.2 | 21.8 | 21.5 | 21.6 |
| | X | 21.82 | | 21.83 | | 22.05 | | 21.70 | |
| 2000 | 20 mm | 21.8 | 21.8 | 21.8 | 21.8 | 22.0 | 21.7 | 21.3 | 21.2 |
| | 40 mm | 21.8 | 21.9 | 21.9 | 21.9 | 22.0 | 21.9 | 21.3 | 21.1 |
| | 60 mm | 21.9 | 21.8 | 21.9 | 21.9 | 21.9 | 22.0 | 21.3 | 21.2 |
| | X | 21.83 | | 21.87 | | 21.92 | | 21.23 | |
| 2500 | 20 mm | 21.8 | 21.8 | 21.8 | 21.8 | 22.1 | 21.6 | | |
| | 40 mm | 21.7 | 21.8 | 21.9 | 21.9 | 22.0 | 21.3 | | |
| | 60 mm | 21.8 | 21.8 | 21.9 | 21.9 | 21.8 | 21.4 | | |
| | X | 21.78 | | 21.67 | | 21.70 | | | |
| 3000 | 20 mm | 21.8 | 21.8 | 21.8 | 21.7 | | | | |
| | 40 mm | 21.8 | 21.8 | 21.9 | 21.9 | | | | |
| | 60 mm | 21.8 | 21.8 | 21.9 | 21.9 | | | | |
| | X | 21.80 | | 21.85 | | | | | |

TABLE 3

| Heat cycle | | Testpiece: Example 1 No. 1 | Example 1 No. 2 | Example 2 No. 1 | Example 2 No. 2 | Comparative Example 1 No. 1 | Comparative Example 1 No. 2 | Comparative Example 2 No. 1 | Comparative Example 2 No. 2 |
|---|---|---|---|---|---|---|---|---|---|
| 3500 | 20 mm | 21.8 | 21.8 | 21.7 | 21.7 | | | | |
| | 40 mm | 21.8 | 21.8 | 21.8 | 21.9 | | | | |
| | 60 mm | 21.8 | 21.8 | 21.9 | 21.9 | | | | |
| | X | 21.80 | | 21.82 | | | | | |
| 4000 | 20 mm | 21.8 | 21.8 | 21.7 | 21.7 | | | | |
| | 40 mm | 21.8 | 21.8 | 21.8 | 21.8 | | | | |
| | 60 mm | 21.8 | 21.8 | 21.9 | 21.8 | | | | |
| | X | 21.80 | | 21.78 | | | | | |
| 4500 | 20 mm | | | 21.7 | 21.7 | | | | |
| | 40 mm | | | 21.8 | 21.8 | | | | |
| | 60 mm | | | 21.9 | 21.8 | | | | |
| | X | | | 21.78 | | | | | |
| 5000 | 20 mm | | | 21.7 | 21.7 | | | | |
| | 40 mm | | | 21.8 | 21.8 | | | | |
| | 60 mm | | | 21.9 | 21.8 | | | | |
| | X | | | 21.78 | | | | | |
| 5444 | 20 mm | | | 0.0 | 21.6 | | | | |
| | 40 mm | | | 21.7 | 21.7 | | | | |
| | 60 mm | | | 21.7 | 21.8 | | | | |
| | X | | | 18.08 | | | | | |
| | | 4000 cycles of tests repeated | | 5444 cycles of tests repeated | | 2500 cycles of tests repeated | | 2000 cycles of tests repeated | |

What is claimed is:

1. A thermal spraying composite material comprising:

molybdenum boride (MoB), from about 40 to about 60% by weight;

a metal selected from the group consisting of nickel (Ni) and cobalt (Co), from about 20 to about 40% by weight; and chromium (Cr), from about 5 to about 20% by weight; and at least one metal boride selected from the group consisting of borides of Cr, Zr, and Nb, from about 5 to about 10% by weight.

2. A thermal spraying composite material according to claim 1, wherein said metal boride is chromium boride ($CrB_2$).

3. A coat formed by thermal spraying on a substrate to be protected, and comprising:

a first layer formed on said substrate from a heat-resisting alloy having a coefficient of thermal expansion in the range of approximately $15\times10^{-6}/°$ C. to $16\times10^{-6}/°$ C.;

a second layer formed on said first layer from a composite material comprising from about 40 to about 60% by weight of molybdenum boride (MoB), from about 20 to about 40% by weight of a metal selected from the group consisting of nickel (Ni) and cobalt (Co), from about 5 to about 20% by weight of chromium (Cr), and from about 5 to about 10% by weight of at least one metal boride selected from the group consisting of the borides of Cr, Zr, and Nb; and a third layer formed on said second layer from a ceramic material with a wettability to any molten light alloy sufficiently low to protect said layer from any physical damage inflicted from said molten light alloy.

4. A coat according to claim 3, wherein said heat-resisting alloy is selected from the group consisting of a nickel-chromium-aluminum (NiCrAl) alloy, a NiCrAlY alloy, a CoCrAlY alloy and a stellite-alloy.

5. A coat according to claim 3, wherein said metal boride is chromium boride ($CrB_2$).

6. A coat according to claim 3, wherein said ceramic material is selected from the group consisting of a stabilized zirconia and an alumina-zirconia mixture.

7. A coat according to claim 3, wherein said third layer is reinforced with a heat-resisting organosilicon compound incorporated by impregnation.

8. A coat according to claim 6, wherein said third layer is reinforced with a heat-resisting organosilicon compound incorporated by impregnation.

9. A coat according to claim 7, wherein said organosilicon compound is polymetallocarbosilane.

10. A coat according to claim 8, wherein said organosilicon compound is polymetallocarbosilane.

11. A coat according to claim 6, wherein said stabilized zirconia is $ZrO_2.Y_2O_3$ or $ZrO_2.CaO$.

12. A coat according to claim 6, wherein said alumina-zirconia mixture is $Al_2O_3$—$ZrO_2$.

13. A coat according to claim 3, wherein the substrate has a coefficient of thermal expansion of $10–20\times10^{-6}/°$ C.

* * * * *